United States Patent [19]

Lopatto, III

[11] 3,940,132

[45] Feb. 24, 1976

[54] TENNIS SERVICE INSTRUCTIONAL DEVICE

[76] Inventor: John S. Lopatto, III, 103 Gaylord Ave., Plymouth, Pa. 18561

[22] Filed: June 13, 1974

[21] Appl. No.: 479,183

[52] U.S. Cl. ..... 273/29 A; 273/26 E; 273/95 A

[51] Int. Cl.[2] ..... A63B 61/00

[58] Field of Search .... 273/29 R, 26 R, 26 A, 26 E, 273/200 R, 208, 184 B, 185 C, 95 A, 196, 197 R, 197 A, 200 A, 95 C; 46/44; 294/64 R, 64 A, 64 B, 65

[56] References Cited

UNITED STATES PATENTS

| | | | |
|---|---|---|---|
| 1,431,702 | 10/1922 | Smend et al. | 294/64 R X |
| 3,006,647 | 10/1961 | Haskett | 273/26 E |
| 3,318,068 | 5/1967 | Voullaire | 294/64 R X |
| 3,397,885 | 8/1968 | Nash, Jr. | 273/26 E |

FOREIGN PATENTS OR APPLICATIONS

| | | | |
|---|---|---|---|
| 1,506,470 | 11/1967 | France | 273/29 R |
| 613,776 | 11/1935 | Germany | 273/29 R |
| 489,842 | 8/1938 | United Kingdom | 273/29 R |
| 240,652 | 10/1925 | United Kingdom | 273/29 A |

*Primary Examiner*—Anton O. Oechsle
*Assistant Examiner*—T. Brown
*Attorney, Agent, or Firm*—Jay M. Cantor

[57] ABSTRACT

In order to aid in the instructions of the service stroke in tennis, a tennis ball is releasably held by suction at the mouth of a suspended supple hose at the proper height to be stroked by a tennis racquet as in serving. The ball is easily released from the restraining force of the suction upon impact by the tennis racquet.

5 Claims, 2 Drawing Figures

TENNIS SERVICE INSTRUCTIONAL DEVICE

The invention contemplates an apparatus for use as an aid in teaching and practicing the serving of a ball in the game of tennis. When serving, the player tosses the ball straight up with a force, such that the ball will stop travelling upwardly at a desired height, which height is most suited for the individual player to serve the ball by stroking it into a desired location in the opposite court. A person who is learning to serve a ball, finds it difficult to coordinate his movements so that he can toss the ball straight up to a height at which it would be most desirable to strike the ball and get into position to strike it at the proper time. By concentrating on obtaining a proper toss and watching the ball, he is distracted from properly hitting the ball so as to place it at a selected desirable location in the opponent's court.

It is therefore highly desirable that some way be found for holding a tennis ball releasably suspended at the proper height to be impacted by the racquet in a service stroke, so as to enable the learner to concentrate on causing the ball to travel to a desired location. In this way, the learner's jerky toss that is necessary for the ball to reach proper height and which is often missed by a learner, is eliminated. In order to accomplish this, I have devised an elongated supple tubular hose which is suspended from one end and also connected to a source of suction. A tennis ball placed at the opposite open end of the hose is held suspended by the suction which is just sufficient to counteract the weight of the ball. Since the hose is supple, readily yieldably and highly flexible, it will provide a minimum impediment to the stroke movement of the racquet against the ball.

It is therefore one object of the invention to provide a device for releasably suspending a tennis ball at the proper height to be impacted by a racquet in simulating a service stroke.

It is another object of the invention to provide a suspended device for releasably grasping a portion of the periphery of a tennis ball, the device offering a minimum of impediment to the striking of a tennis ball by the racquet.

It is a further object of the invention to releasably suspend a tennis ball from a portable stand in a manner described in the above objects.

An additional object is to provide a ball replacing device in the above releasable ball grasping element.

The above and still further objects of this invention will become apparent as a description of the invention proceeds with specific reference to the FIGS. of the drawing in which.

Figure 1:
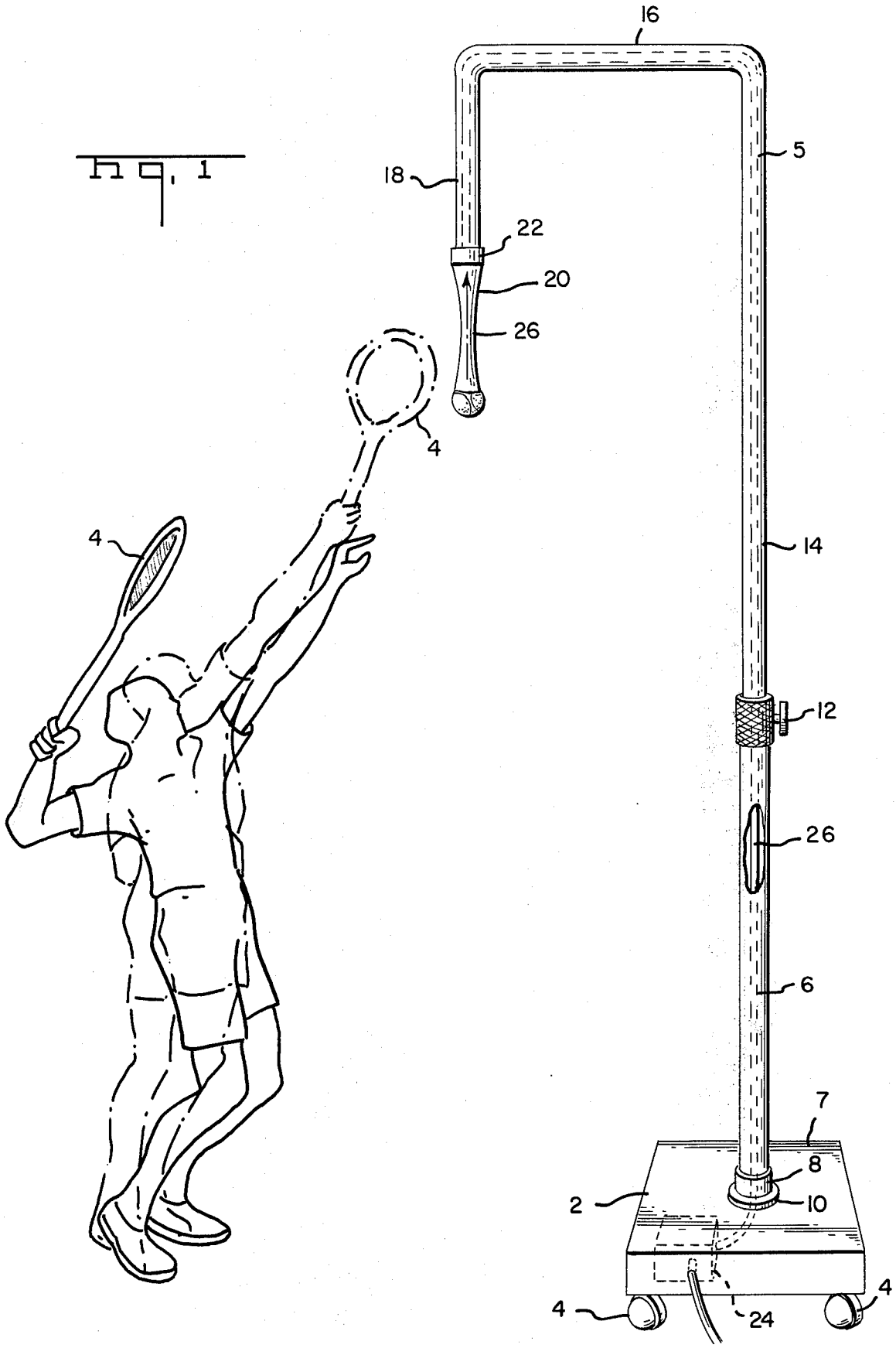
FIG. 1 is a view of the apparatus assembled ready for use by a player.

As shown in FIG. 1, a relatively massive base 2 is supported on caster wheels or rolls 4 so as to be capable of movement to a desired location. Secured to the upper surface of the base 2 is a vertically extending mast 6. The mast may be hollow and provided at the lower end with a flanged collar 8 by which it is secured to the base, either by welding, if both the base and collar are of metal or by bolts 10 extending through the flange into the base 2. A collar 12 surrounds the upper end of the mast 6 and is provided with a threaded opening extending laterally from its periphery intermediate its ends for the reception of a thumb screw 12. The mast is provided with a lateral opening through which the thumb screw may extend. Telescopically arranged within the upper portion of the mast 6, is a tubular rod 14 formed at its upper end with a tubular lateral arm extension 16. The end of the arm extension is provided with a downwardly extending tubular portion 18. A highly supple, flexible and readily yieldable tubular hose 20, which may be of rubber or plastic, has one end tightly fitted over the open end of the downwardly extending portion 18 and secured thereon by means of a ferrule or clamp 22.

An electrically operated suction pump 24 is mounted on the underside of the base for the purpose of creating suction within the tubular member 20 by means of a conduit 26 extending from the inlet of the suction pump through the mast 6, rod 14, arm 16 and extension 18 and leading into the upper end of supple member 20. To prevent collapse of the supple tubular member 20 when subjected to suction, a stiffened diametrically extending finger 26 can be attached to the interior wall of the member 26 without preventing suction at the open mouth thereof. When a tennis ball is placed against the open mouth of the tubular member 20, suction produced by the pump 24 will be sufficient to hold the ball therein. Obviously, the mouth of member 26 should have a diameter which is somewhat smaller than that of the tennis ball so that no more than half of the periphery and preferably less, enters the mouth thereof. The rod 14 is vertically adjustable within the mast and maintains the ball at the proper height for the particular learner, by means of the thumb screw 12 bearing thereagainst.

Figure 2:
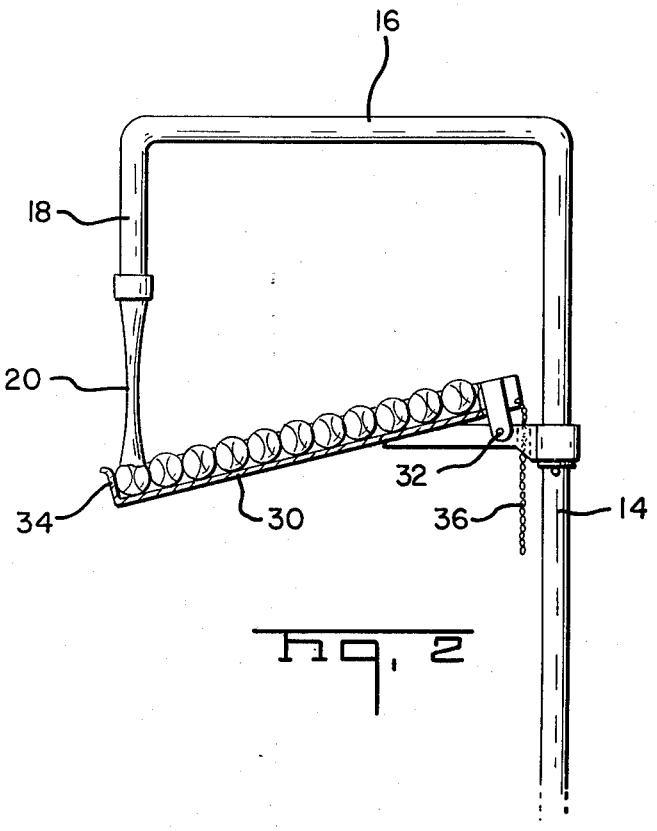
FIG. 2 is a fragmentary view of the apparatus of FIG. 1 with the addition of a ball replenshing device which may be attached thereto.

As the ball is struck by the learner swinging his racquet thereagainst, the impact causes the ball to break the suction and travel freely to the destination. Due to the highly yieldable nature of the member 20, there will be but little impedance to the free swing of the racquet. An arrangement may be provided for replacing the ball in the mouth of the member 20 without having to stand on a stool. Such an arrangement, as shown in FIG. 2, may be in the form of an elongated tube 30 having an internal diameter substantially that of a tennis ball. One end of the tube 30 may be pivotally mounted on the rod for swinging movements on a horizontal axis 32 relative to the rod. The opposite end of the tube 30 is closed by an end wall 34 and a portion of the periphery of the tube, just rearwardly of the wall, is cut away to expose the lowermost ball of the series of balls within the tube. When the tube 30 is swung upwardly by pulling a string connected to the end of the tube rearwardly of the axis 32, the tube is swung upwardly to place the lowermost ball in the open mouth of the tubular member 20 to which the ball will adhere by the suction in the member 20. The tube 30 is then permitted to lower to substantially a vertical position and the balls in the tube roll down until the endmost ball abuts the wall 34. After each ball is released from the tubular member 20, the string 36 is pulled to replace the ball in the mouth of member 20.

The apparatus above described has practical utility for the purpose of practicing service of a tennis ball, is simple and uncomplicated, in structure, economical to produce and may be moved to any location either indoors or outdoors.

While I have shown and described a reloading arrangement which includes a tubular arm 30 swingable about a horizontal pivot in order to move a ball stored therein toward the mouth of the tubular hose 20, the arm may also be mounted on the post 14 to swing horizontally thereabout or about a vertical pivot parallel to the post to present a ball to the hose, the arm being normally biased to a position 180° away from that shown in FIG. 2. If it is not desired to utilize reloading devices as above described, one may obviously utilize a stick having a support for a ball at its upper end, for moving the ball to the mouth of the hose.

While I have described only one preferred embodiment of my invention by way of illustration, it will be evident that many modifications will occur to those skilled in the art and that I therefore, intend by the appended claims to cover all such modifications as fall within the true spirit and scope of my invention.

What is claimed is:

1. An apparatus for use as an aid in learning the service stroke in tennis comprising, a substantially vertical overhead support, supple flexibly yieldable tubular means suspended from said support, said tubular means having a lower open end for seating against the uppermost portion of the surface of a tennis ball placed at a height above a player's head, and means for applying suction to the other end of said tubular means with a force which is just sufficient to maintain the weight of the ball in said open end but to be overcome to release the ball by impact of a racquet striking against the ball during a service stroke.

2. An apparatus according to claim 1 including a an arm secured to the vertical support extending at an angle therefrom and comprising said overhead support, said tubular element being suspended vertically from said arm.

3. An apparatus according to claim 2 including means for adjusting the height of said arm on the vertical support.

4. An apparatus according to claim 1 further including a movable ground engaging base on which the vertical support is mounted.

5. An apparatus according to claim 1 including a ball storage means, means mounting the storage means on said substantially vertical support for movement to seat a ball in the open end of the tubular means.

* * * * *